US006600464B1

(12) United States Patent
Smith

(10) Patent No.: US 6,600,464 B1
(45) Date of Patent: Jul. 29, 2003

(54) METHOD FOR REDUCING CROSS-TALK IN A FIELD EMISSION DISPLAY

(75) Inventor: Robert T. Smith, Tempe, AZ (US)

(73) Assignee: Motorola, Inc., Schaumburg, IL (US)

( * ) Notice: Subject to any disclaimer, the term of this patent is extended or adjusted under 35 U.S.C. 154(b) by 288 days.

(21) Appl. No.: 09/658,170

(22) Filed: Sep. 8, 2000

(51) Int. Cl.[7] ..... G09G 3/22
(52) U.S. Cl. ..... 345/75.2; 345/58
(58) Field of Search ..... 345/75.2, 735.8, 345/204, 87, 58; 313/582, 584, 495, 427, 309; 445/24

(56) References Cited

U.S. PATENT DOCUMENTS 5,075,683 A 12/1991 Ghis ..... 340/793
5,138,308 A 8/1992 Clerc et al. ..... 340/758
5,691,739 A * 11/1997 Kawamori et al. ..... 345/209
5,742,267 A 4/1998 Wilkinson ..... 345/77
5,754,148 A 5/1998 Kishino et al.
5,838,287 A * 11/1998 Kuijk ..... 345/58
6,031,344 A 2/2000 Foo et al. ..... 315/307
6,060,840 A 5/2000 Foo et al. ..... 315/169.1
6,069,597 A 5/2000 Hansen ..... 345/74
6,069,599 A * 5/2000 Py et al. ..... 345/74.1
6,204,834 B1 * 3/2001 Baker et al. ..... 315/169.1
6,369,786 B1 * 4/2002 Suzuki ..... 345/77
6,542,136 B1 * 4/2003 Smith ..... 345/75.2

* cited by examiner

*Primary Examiner*—Richard Hjerpe
*Assistant Examiner*—Francis Nguyen
(74) *Attorney, Agent, or Firm*—William E. Koch

(57) ABSTRACT

Method reducing cross-talk between adjacent column conductors in a field emission display (10) that has a plurality of column conductors (17A, 17B, 17C, 18A, 18B, 18C) on which electron emission structures (24) are disposed. The field emission display (10), also includes a plurality of row conductors (27, 28, 29). Cross-talk is prevented by ensuring that adjacent conductors are not in an active state at the same time.

26 Claims, 4 Drawing Sheets

METHOD FOR REDUCING CROSS-TALK IN A FIELD EMISSION DISPLAY

CROSS REFERENCE TO RELATED APPLICATIONS

The present invention is related to U.S. Patent Application entitled "FIELD EMISSION DISPLAY AND METHOD," to Robert T. Smith and having attorney docket number FD20025, which application is incorporated herein by reference.

FIELD OF THE INVENTION

The present invention relates, in general, to field emission displays and, more particularly, to methods and circuits for controlling emission current in the field emission displays.

BACKGROUND OF THE INVENTION

Field emission displays (FED's) are well known in the art. A field emission display includes an anode plate and a cathode plate that define a thin envelope. The cathode plate includes a matrix of column conductors and row conductors, which are used to cause electron emission from electron emitter structures such as, Spindt tips. FED's further include ballast resistors between the electron emitter structures and the cathode plate for controlling the electron emission current. In addition to the desired FED components, a parasitic fringe capacitance is formed between adjacent column conductors. These parasitic fringe capacitances allow cross-talk between adjacent column conductors when one of the column conductors switches from a high impedance state to a high voltage state. The cross-talk may result in a glitch on the column conductor that remains in the high impedance state where the glitch introduces error that appears in the picture appearing on the field emission display.

Accordingly, there exists a need for a method for controlling the adjacent column capacitance in a field emission display, which overcomes at least some of these shortcomings.

BRIEF DESCRIPTION OF THE DRAWINGS

For simplicity and clarity of illustration, elements in the drawings are not necessarily drawn to scale, and the same reference numerals in different figures denote the same elements.

DETAILED DESCRIPTION OF THE DRAWINGS

Generally, the present invention is for a method of reducing cross-talk between adjacent columns in a Field Emission Display (FED). The method includes activating alternate column conductors of the FED such that adjacent column conductors do not both switch during the same portion of a single line time. In accordance with one embodiment of the present invention, during a single scan, a frame is divided into two sub-frames in which alternate column conductors are activated. In accordance with another embodiment of the present invention, a single line time is divided into two portions. Then a single row is selected and during the first portion of the single line time every other column conductor of the display is activated. During the second portion of the single line time the column conductors not activated during the first portion are activated, i.e., the alternate column conductors that were not activated during the first portion of the single line time are activated during the second portion of the single line time.

Figure 1:
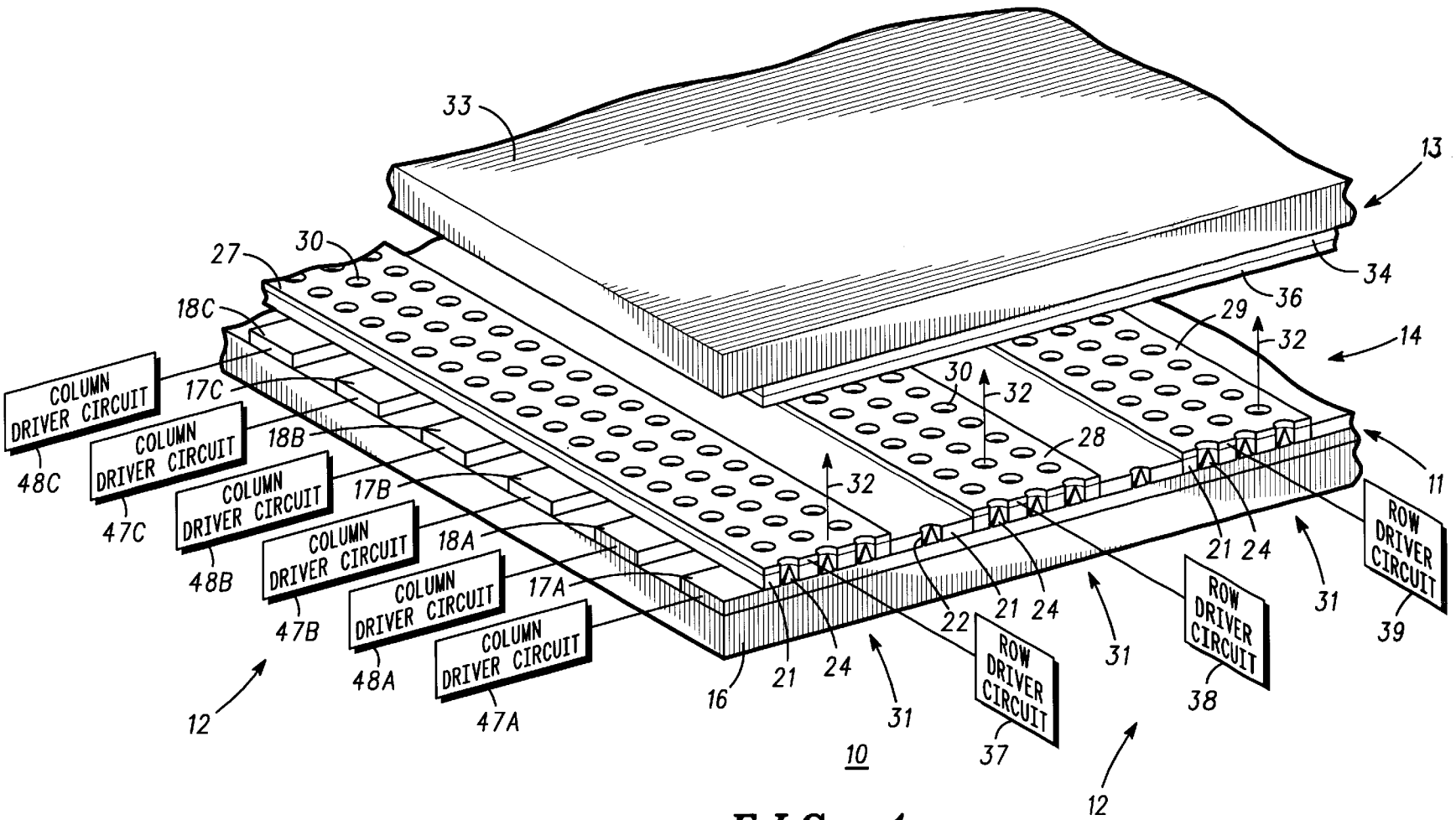
FIG. 1 is a partially cut-away isometric view and circuit schematic representation of a field emission display for use in accordance with an embodiment of the present invention.

FIG. 1 is a partially cut-away isometric view and circuit schematic representation of a field emission display (FED) 10 in accordance with an embodiment of the present invention. FED 10 includes an FED device 11 and control circuitry 12 for controlling emission current in FED device 11.

FED device 11 includes a cathode plate 13 and an anode plate 14. Cathode plate 13 includes a substrate 16, which can be made from glass, silicon, and the like. A plurality of column conductors 17A, 17B, and 17C and a plurality of column conductors 18A, 18B, and 18C are disposed on substrate 16. Plurality of column conductors 17A, 17B, and 17C are interdigitated with plurality of column conductors 18A, 18B, and 18C. It should be noted that column conductors 17A, 17B, and 17C are related to one another in that they are capable of being activated during a same portion of the line time, while column conductors 18A, 18B, and 18C are turned off or inactivated. Likewise, column conductors 18A, 18B, and 18C are related to one another in that they are capable of being activated during the same portion of the line time, while column conductors 17A, 17B, and 17C are turned off or inactivated. A dielectric layer 21 is disposed upon column conductors 17A, 17B, 17C, 18A, 18B, and 18C, and further defines a plurality of wells 22.

An electron emitter structure 24 such as, for example, a Spindt tip, is disposed in each of wells 22. Row conductors 27, 28, and 29 are formed on dielectric layer 21. Row conductors 27, 28, and 29 are spaced apart from and proximate to electron emitter structures 24. Row conductors 27, 28, and 29 include a plurality of apertures 30 which cooperate with corresponding wells 22 and electron emitter structures 24 to form current emission regions 31. Column conductors 17A, 17B, 17C, 18A, 18B, and 18C and row conductors 27, 28, and 29 are used to selectively address electron emitter structures 24.

To facilitate understanding the present invention, FIG. 1 depicts only three row conductors and six column conductors. However, it is desired to be understood that any number of row and column conductors can be employed. An exemplary number of row conductors for an FED device is 240 and an exemplary number of column conductors is 960. Methods for fabricating cathode plates for matrix-addressable field emission displays are known to one of ordinary skill in the art.

Anode plate 14 is disposed to receive an emission current 32, which is defined by the electrons emitted by electron emitter structures 24. Anode plate 14 includes a transparent substrate 33 made from, for example, glass. An anode 34 is disposed on transparent substrate 33. Anode 34 is preferably made from a transparent conductive material, such as indium tin oxide. In the preferred embodiment, anode 34 is a continuous layer that opposes the entire emissive area of cathode plate 13. That is, anode 34 preferably opposes the entirety of electron emitter structures 24.

A plurality of phosphors 36 is disposed upon anode 34. Phosphors 36 are cathodoluminescent. Thus, phosphors 36 emit light upon activation by emission current 32. Methods for fabricating anode plates for matrix-addressable field emission displays are also known to one of ordinary skill in the art.

In accordance with one embodiment of the present invention, control circuitry 12 comprises row conductor driver circuits 37, 38, and 39 and column conductor driver circuits 47A, 47B, 47C, 48A, 48B, and 48C. Row conductor driver circuits 37, 38, and 39 are coupled to row conductors 27, 28, and 29, respectively, and column conductor driver circuits 47A, 47B, 47C, 48A, 48B, and 48C are coupled to column conductors 17A, 17B, 17C, 18A, 18B, and 18C, respectively.

Figure 2:
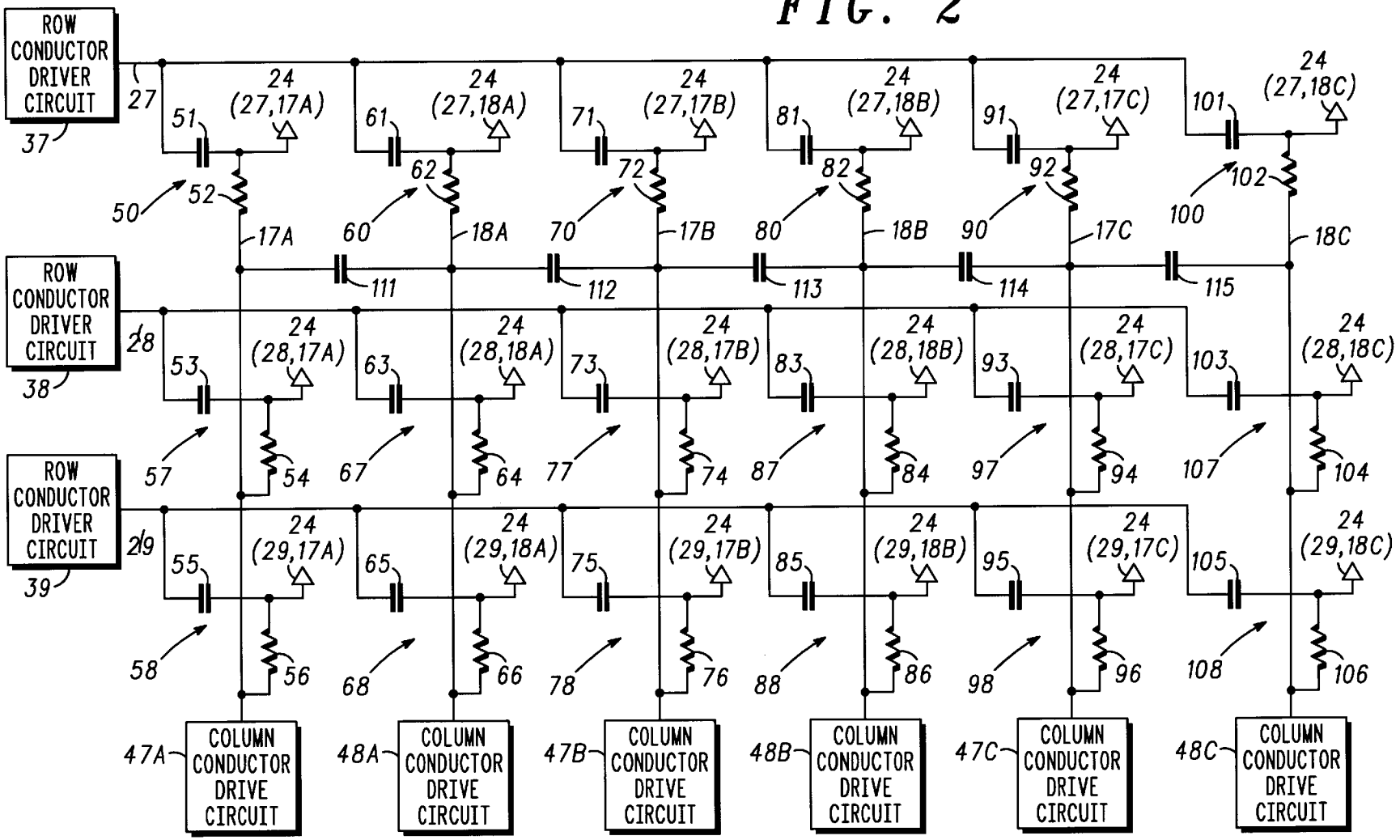
FIG. 2 is an equivalent circuit representation of the field emission display portion of FIG. 1.

FIG. 2 is a schematic diagram of cathode plate 13 of FED 10. What is shown in FIG. 2 is a schematic representation of column conductors 17A, 17B, 17C, 18A, 18B, and 18C, column conductor driver circuits 47A, 47B, 47C, 48A, 48B, and 48C, row conductors 27, 28, and 29, and row conductor driver circuits 37, 38, and 39. It should be understood that although three row conductor driver circuits and six column conductor driver circuits are shown, there may be a fewer number or a greater number of row conductor driver circuits and a fewer number or a greater number of column conductor driver circuits.

FIG. 2 further illustrates electron emission structures, sub-pixel capacitances, parasitic fringe capacitances, and ballast resistors associated with each row and column of FED 10. More particularly, sub-pixel capacitance 51, sub-pixel ballast resistor 52, and electron emission structure $\mathbf{24}_{(27,\ 17A)}$ associated with sub-pixel 50 are shown as being coupled to row conductor 27 and column conductor 17A. Electron emission structure $\mathbf{24}_{(27,\ 17A)}$ is shown as a lumped element representing all the electron emission structures associated with sub-pixel 50. It should be understood that the reference number 24 has been used to identify electron emitter structures in general. To help explain the embodiment shown in FIG. 2, the electron emission structures have been further defined by appending subscripts to reference number 24. For example, the electron emission structures associated with row conductor 27 and column conductor 17A have been identified by reference number $\mathbf{24}_{(27,\ 17A)}$ the electron emission structures associated with row conductor 28 and column conductor 17A have been identified by reference number $\mathbf{24}_{(28,\ 17A)}$, the electron emission structures associated with row conductor 27 and column conductor 18A have been identified by reference number $\mathbf{24}_{(27,\ 18A)}$, etc.

Sub-pixel capacitance 53, sub-pixel ballast resistor 54, and electron emission structure $\mathbf{24}_{(28,\ 17A)}$ associated with sub-pixel 57 are shown as being coupled to row conductor 28 and column conductor 17A. Electron emission structure $\mathbf{24}_{(28,\ 17A)}$ is shown as a lumped element representing all the electron emission structures associated with sub-pixel 57.

Sub-pixel capacitance 55, sub-pixel ballast resistor 56, and electron emission structure $\mathbf{24}_{(29,\ 17A)}$ associated with sub-pixel 58 are shown as being coupled to row conductor 29 and column conductor 17A. Electron emission structure $\mathbf{24}_{(29,\ 17A)}$ is shown as a lumped element representing all the electron emission structures associated with sub-pixel 58.

Sub-pixel capacitance 61, sub-pixel ballast resistor 62, and electron emission structure $\mathbf{24}_{(27,\ 18A)}$ associated with sub-pixel 60 are shown as being coupled to row conductor 27 and column conductor 18A. Electron emission structure $\mathbf{24}_{(27\ 18A)}$ is shown as a lumped element representing all the electron emission structures associated with sub-pixel 60.

Sub-pixel capacitance 63, sub-pixel ballast resistor 64, and electron emission structure $\mathbf{24}_{(28,\ 18A)}$ associated with sub-pixel 67 are shown as being coupled to row conductor 28 and column conductor 18A. Electron emission structure $\mathbf{24}_{(28,\ 18A)}$ is shown as a lumped element representing all the electron emission structures associated with sub-pixel 67.

Sub-pixel capacitance 65, sub-pixel ballast resistor 66, and electron emission structure $\mathbf{24}_{(29,\ 18A)}$ associated with sub-pixel 68 are shown as being coupled to row conductor 29 and column conductor 18A. Electron emission structure $\mathbf{24}_{(29,\ 18A)}$ is shown as a lumped element representing all the electron emission structures associated with sub-pixel 68.

Sub-pixel capacitance 71, sub-pixel ballast resistor 72, and electron emission structure $\mathbf{24}_{(27,\ 17B)}$ associated with sub-pixel 70 are shown as being coupled to row conductor 27 and column conductor 17B. Electron emission structure $\mathbf{24}_{(27,\ 17B)}$ is shown as a lumped element representing all the electron emission structures associated with sub-pixel 70.

Sub-pixel capacitance 73, sub-pixel ballast resistor 74, and electron emission structure $\mathbf{24}_{(28,\ 17B)}$ associated with sub-pixel 77 are shown as being coupled to row conductor 28 and column conductor 17B. Electron emission structure $\mathbf{24}_{(28,\ 17B)}$ is shown as a lumped element representing all the electron emission structures associated with sub-pixel 77.

Sub-pixel capacitance 75, sub-pixel ballast resistor 76, and electron emission structure $\mathbf{24}_{(29,\ 17B)}$ associated with sub-pixel 78 are shown as being coupled to row conductor 29 and column conductor 17B. Electron emission structure $\mathbf{24}_{(29,\ 17B)}$ is shown as a lumped element representing all the electron emission structures associated with sub-pixel 78.

Sub-pixel capacitance 81, sub-pixel ballast resistor 82, and electron emission structure $\mathbf{24}_{(27,\ 18B)}$ associated with sub-pixel 80 are shown as being coupled to row conductor 27 and column conductor 18B. Electron emission structure $\mathbf{24}_{(27,\ 18B)}$ is shown as a lumped element representing all the electron emission structures associated with sub-pixel 80.

Sub-pixel capacitance 83, sub-pixel ballast resistor 84, and electron emission structure $\mathbf{24}_{(28,\ 18B)}$ associated with sub-pixel 87 are shown as being coupled to row conductor 28 and column conductor 18B. Electron emission structure $\mathbf{24}_{(28,\ 18B)}$ is shown as a lumped element representing all the electron emission structures associated with sub-pixel 87.

Sub-pixel capacitance 85, sub-pixel ballast resistor 86, and electron emission structure $\mathbf{24}_{(29,\ 18B)}$ associated with sub-pixel 88 are shown as being coupled to row conductor 29 and column conductor 18B. Electron emission structure $\mathbf{24}_{(29,\ 18B)}$ is shown as a lumped element representing all the electron emission structures associated with sub-pixel 88.

Sub-pixel capacitance 91, sub-pixel ballast resistor 92, and electron emission structure $\mathbf{24}_{(27,\ 17C)}$ associated with sub-pixel 90 are shown as being coupled to row conductor 27 and column conductor 17C. Electron emission structure $\mathbf{24}_{(27,\ 17C)}$ is shown as a lumped element representing all the electron emission structures associated with sub-pixel 90.

Sub-pixel capacitance 93, sub-pixel ballast resistor 94, and electron emission structure $\mathbf{24}_{(28,\ 17C)}$ associated with sub-pixel 97 are shown as being coupled to row conductor 28 and column conductor 17C. Electron emission structure $\mathbf{24}_{(28,\ 17C)}$ is shown as a lumped element representing all the electron emission structures associated with sub-pixel 97.

Sub-pixel capacitance 95, sub-pixel ballast resistor 96, and electron emission structure $\mathbf{24}_{(29,\ 17C)}$ associated with sub-pixel 98 are shown as being coupled to row conductor 29 and column conductor 17C. Electron emission structure $\mathbf{24}_{(29,\ 17C)}$ is shown as a lumped element representing all the electron emission structures associated with sub-pixel 98.

Sub-pixel capacitance 101, sub-pixel ballast resistor 102, and electron emission structure $\mathbf{24}_{(27,\ 18C)}$ associated with sub-pixel 100 are shown as being coupled to row conductor 27 and column conductor 18C. Electron emission structure $\mathbf{24}_{(27,\ 18C)}$ is shown as a lumped element representing all the electron emission structures associated with sub-pixel 100.

Sub-pixel capacitance 103, sub-pixel ballast resistor 104, and electron emission structure $\mathbf{24}_{(28,\ 18C)}$ associated with sub-pixel 107 are shown as being coupled to row conductor 28 and column conductor 18C. Electron emission structure $\mathbf{24}_{(28,\ 18C)}$ is shown as a lumped element representing all the electron emission structures associated with sub-pixel 107.

Sub-pixel capacitance 105, sub-pixel ballast resistor 106, and electron emission structure $\mathbf{24}_{(29,\ 18C)}$ associated with sub-pixel 108 are shown as being coupled to row conductor 29 and column conductor 18C. Electron emission structure $\mathbf{24}_{(29,\ 18C)}$ is shown as a lumped element representing all the electron emission structures associated with sub-pixel 108.

Column conductor 17A is coupled to column conductor 18A via a parasitic fringe capacitance 111. Capacitance 111 couples cross-talk between a column conductor that is switching from being in a high impedance state to one at a high voltage. For example if sub-pixels 50 and 60 are both "on," i.e., emitting current, then column driver circuits 47A and 48A are in a high impedance state. Capacitances 51 and 61 are discharging and capacitors 53, 63, 55, and 65 are discharging at rates defined by the currents being emitted by the respective sub-pixels 50 and 60. When sub-pixel 50 has emitted a sufficient charge, column driver circuit 17A switches to a high voltage, $V_{COL}$, thereby turning off sub-pixel 50. Assuming sub-pixel 60 has not yet emitted enough charge, column driver circuit 48A remains in a high impedance state. However, a voltage glitch is produced on column conductor 18A by the switching of column conductor driver circuit 47A.

The approximate amplitude of the voltage glitch, $V_{GLI47A}$, is approximated by:

$$V_{GLI47A} \approx V_{COL} * C_{111}/(C_{51}+C_{53}+C_{55})$$

where $V_{COL}$ is the column switching voltage;

$C_{111}$ is the capacitance value of capacitance 111;

$C_{51}$ is the capacitance value of capacitance 51;

$C_{53}$ is the capacitance value of capacitance 53; and $C_{55}$ is the capacitance value of capacitance 55.

In another example, if sub-pixels 97 and 107 are both "on," i.e., emitting current, then column driver circuits 47C and 48C are in a high impedance state. Capacitances 93 and 103 are discharging and capacitances 91, 95, 101, and 105 are charging at rates defined by the currents being emitted by the respective sub-pixels 97 and 107. When sub-pixel 107 has emitted a sufficient charge, column driver circuit 47C switches to a high voltage, thereby turning off sub-pixel 107. Assuming sub-pixel 97 has not yet emitted enough charge, column driver circuit 48C remains in a high impedance state. However, a voltage glitch is produced on column conductor 17C by the switching of column conductor driver circuit 48C.

The approximate amplitude of the voltage glitch, $V_{GLI48C}$, is given by:

$$V_{GLI48C} \approx V_{COL} * C_{115}/(C_{103}+C_{101}+C_{105})$$

where $V_{COL}$ the column switching voltage;

$C_{115}$ is the capacitance value of capacitance 115;

$C_{103}$ is the capacitance value of capacitance 103;

$C_{101}$ is the capacitance value of capacitance 101; and $C_{105}$ is the capacitance value of capacitance 105.

If the glitch is too large, it will degrade the image quality of the display of FED 10. It should be noted that each column conductor is coupled to an adjacent column conductor by a parasitic fringe capacitance. In the present embodiment, column conductor 18A is coupled to column conductor 17B by fringe capacitance 112; column conductor 17B is coupled to column conductor 18B by fringe capacitance 113; column conductor 18B is coupled to column conductor 17C by fringe capacitance 114; and column conductor 17C is coupled to column conductor 18C by fringe capacitance 115.

Figure 3:
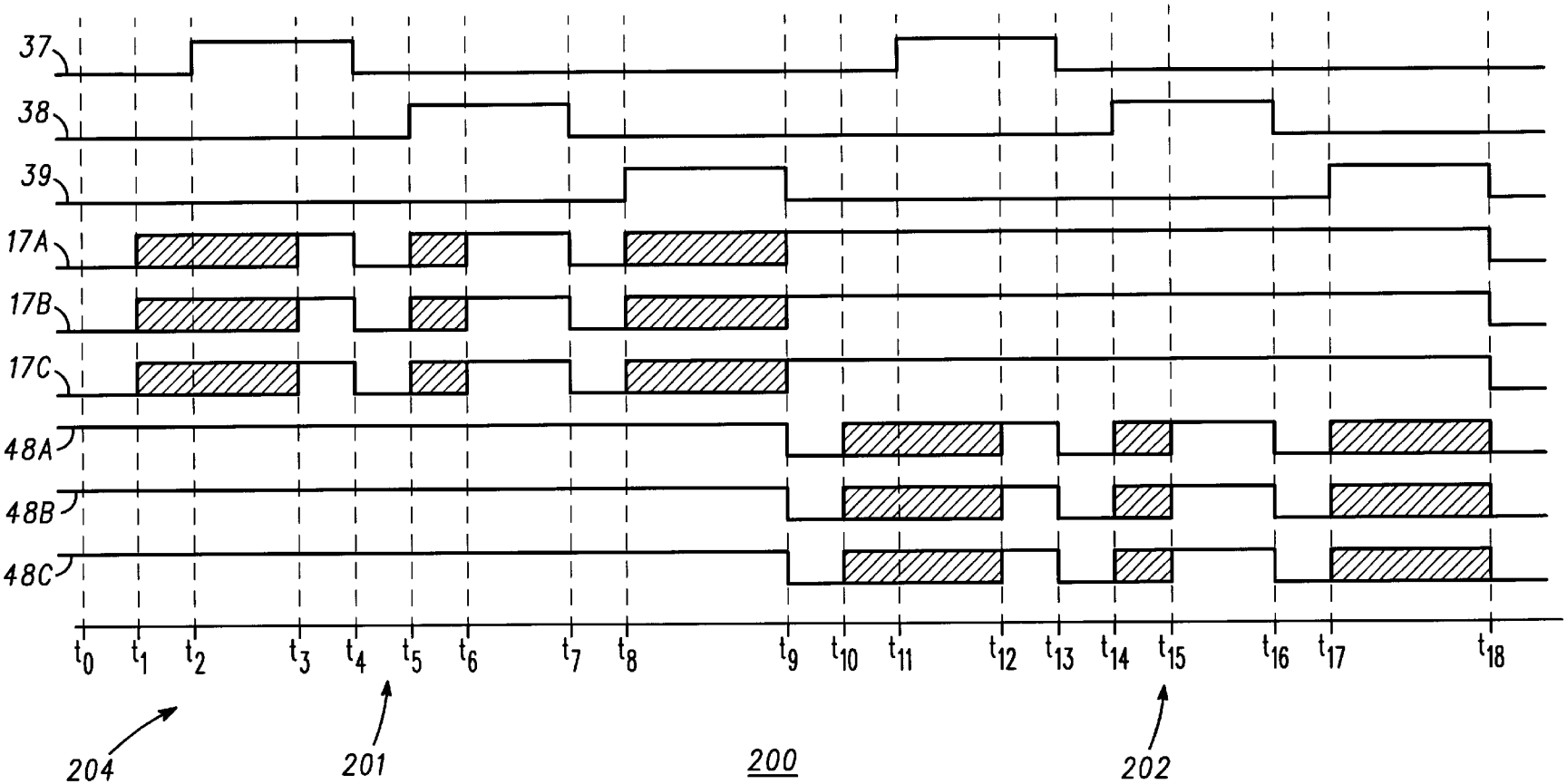
FIG. 3 is a timing diagram for the operation of the field emission display of FIG. 1 in accordance with an embodiment of the present invention.

FIG. 3 is a timing diagram 200 illustrating a method for operating FED 10 in a display mode in accordance with an embodiment in which one frame is divided into two sub-frames. In the first sub-frame, one set of column conductors is activated, i.e., column conductors 17A, 17B, and 17C, and in the second sub-frame, a second set of column conductors that are adjacent the first set of column conductors is activated, i.e., column conductors 18A, 18B, and 18C. The display mode is characterized by the creation of a display image at anode 14. It should be understood that timing diagram 200 shown in FIG. 3 will be described together with FIGS. 1 and 2. Represented in FIG. 3 is the selective addressing and activation of sub-pixels 50, 57, 58, 60, 67, 68, 70, 77, 78, 80, 87, 88, 90, 97, 98, 100, 107, and 108. In accordance with the present invention, during a sub-frame 201 of a frame 200, alternate column conductors are in an active mode, i.e., column conductors 17A, 17B, and 17C are in an active mode and column conductors 18A, 18B, and 18C are in an inactivate mode or turned off. During a sub-frame 202 of frame 200, column conductors 18A, 18B, and 18C are in an active mode and column conductors 17A, 17B, and 17C are in an inactive mode. In other words, during sub-frame 201 the sub-pixels associated with column conductors 17A, 17B, and 17C, i.e., the respective sub-pixels 50, 57, 58, 70, 77, 78, 90, 97, and 98 are capable of conducting current, whereas the sub-pixels associated with column conductors 18A, 18B, and 18C, i.e., respective sub-pixels 60, 67, 68, 80, 87, 88, and 100, 107, and 108 are turned off. During sub-frame 202 of frame 200, the sub-pixels associated with column conductors 18A, 18B, and 18C, i.e., sub-pixels 60, 67, 68, 80, 87, 88, and 100, 107, and 108, are capable of conducting current and the sub-pixels associated with column conductors 17A, 17B, and 17C, i.e., the respective sub-pixels 50, 57, 58, 70, 77, 78, and 90, 97, and 98 are turned off.

Thus, FED 10 is operated so adjacent column conductors are not in an active mode at the same time. For example, if column conductor 18A is in an active mode, column conductors 17A and 17B are inactive or turned off. It should be understood that when in an active mode, the electron emitter structures are capable of emitting electrons. That is to say, they are not necessarily emitting electrons, whereas an in inactive mode, the electron emitter structures are incapable of emitting electrons because the column conductor driver circuits place voltages on the column conductors that prevent the electron emitter structures 24 from emitting current.

At time $t_0$, display capacitances 51, 53, 55, 71, 73, 75, 91, 93, and 95 are discharged to zero volts by driving the output voltage of column conductor driver circuits 47A, 47B, 47C, 48A, 48B, and 48C and row conductor driver circuits 37, 38, and 39 to voltages that prevent the corresponding electron emitter structures from emitting current. By way of example, the output voltages of column conductor driver circuits 47A, 47B, and 47C and the output voltages of row conductor driver circuits 37, 38, and 39 are driven to zero volts, whereas the output voltages of column conductor driver circuits 48A, 48B, and 48C are driven to a high voltage state, e.g., eighty volts. Thus, capacitances 51, 53, 55, 71, 73, 75, 91, 93, and 95 are discharged.

At time $t_1$, column conductor driver circuits 47A, 47B, and 47C are placed in a high impedance state and are, therefore, electrically disconnected from FED 10. Row conductor driver circuits 37, 38, and 39 are then sequentially activated as indicated in timing diagram 200 shown in FIG. 3. Activating row conductor driver circuits such as row conductor driver circuits 37, 38, and 39 is also referred to as applying a row select voltage to the corresponding row electrodes. Similarly, activating a column driver circuit such as, column driver circuits 47A, 47B, 47C, 48A, 48B, 48C is also referred to as applying a column select voltage to the corresponding column conductor. At time $t_1$, row conductor driver circuits 37, 38, and 39 are outputting, for example, zero volts. This places zero volts on row conductors 27, 28, and 29, respectively. The outputs of column conductor driver circuits 47A, 47B, and 47C remain in a high impedance state and the outputs of column conductor driver circuits 48A, 48B, and 48C are at a high voltage.

At time $t_2$, row conductor driver circuit 37 is activated and places a voltage greater than the threshold voltage of the electron emitter structures on row conductor 27. By way of example, the voltage placed on row conductor 27 is eighty volts. Row conductor driver circuits 38 and 39 continue to maintain row conductors 28 and 29, respectively, at zero volts.

When the column conductor driver circuits are in a high impedance state and the electron emitter structures are emitting current, the column conductor driver circuits preferably monitor the voltage on the column conductor. The change in voltage measured on the column conductor is proportional to the charge or current emitted by the electron emitter structures. It should be understood that column conductor driver circuits 47A, 47B, and 47C monitor the voltage on column conductors 17A, 17B, and 17C, respectively, and electron emitter structures $\mathbf{24}_{(27,\ 17A)}$ $\mathbf{24}_{(27,\ 17B)}$ and $\mathbf{24}_{(27,\ 17C)}$ emit electrons or current. Column conductor driver circuits 47A, 47B, and 47C compare the measured change in voltage on the respective column conductors 17A, 17B, and 17C to voltages proportional to the desired intensity of sub-pixels 50, 70, and 90, which proportional voltages were previously determined as described in the U.S. Patent application having Ser. No. 09/658,514 by Robert T. Smith, and assigned to Motorola, Inc, which patent application has been incorporated herein by reference. After electron emitter structures $\mathbf{24}_{(27,\ 17A)}$, $\mathbf{24}_{(27,\ 17B)}$, and $\mathbf{24}_{(27,\ 17C)}$ have emitted the desired current, they are turned off by switching column conductor driver circuits 47A, 47B, and 47C from the high impedance state to a high voltage state. This is shown as occurring at time $t_3$ in FIG. 3.

At time $t_4$, the output voltage of row conductor driver circuit 37 and column conductor driver circuits 47A, 47B, and 47C are switched from a high voltage, e.g., eighty volts, to a low voltage, e.g., zero volts; thereby discharging capacitances 51, 71, and 91 associated with column conductors 17A, 17B, and 17C, respectively.

At time $t_5$, column conductor driver circuits 47A, 47B, and 47C are placed in a high impedance state and the output voltage of row conductor driver circuit 38 transitions from a low voltage state, e.g., zero volts, to a high voltage state, e.g., eighty volts. Column conductor driver circuits 47A, 47B, and 47C monitor the voltage on column conductors 17A, 17B, and 17C, respectively, and electron emitter structures $\mathbf{24}_{(28,\ 17A)}$ $\mathbf{24}_{(28,\ 17B)}$ and $\mathbf{24}_{(28,\ 17C)}$ emit current. Column conductor driver circuits 47A, 47B, and 47C compare the measured change in voltage on the respective column conductors 17A, 17B, and 17C to voltages proportional to the desired intensity of sub-pixels 57, 77, and 97, which proportional voltages were previously determined. Column conductor driver circuits 47A, 47B, and 47C shut off sub-pixels 57, 77, and 97, respectively, after the proper amount of charge or current has been emitted. After the electron emitter structures $\mathbf{24}_{(28,\ 17A)}$, $\mathbf{24}_{(28,\ 17B)}$ and $\mathbf{24}_{(28,\ 17C)}$ have emitted the desired current, they are turned off by switching column conductor driver circuits 47A, 47B, and 47C from the high impedance state to a high voltage state. This is shown as occurring at time $t_6$ in FIG. 3.

At time $t_7$, the output voltage of row conductor driver circuit 38 and column conductor driver circuits 47A, 47B, and 47C switch from a high voltage, e.g., eighty volts, to a low voltage, e.g., zero volts; thereby discharging capacitances 53, 73, and 93 associated with column conductors 17A, 17B, and 17C, respectively.

At time $t_8$, column conductor driver circuits 47A, 47B, and 47C are placed in a high impedance state and the output voltage of row conductor driver circuit 39 transitions from a low voltage state, e.g., zero volts, to a high voltage state, e.g., eighty volts. Column conductor driver circuits 47A, 47B, and 47C monitor the voltages on column conductors 17A, 17B, and 17C and electron emitter structures $\mathbf{24}_{(29,\ 17A)}$, $\mathbf{24}_{(29,\ 17B)}$ and $\mathbf{24}_{(29,\ 17C)}$ emit current. Column conductor driver circuits 47A, 47B, and 47C compare the measured change in voltage on column conductors 17A, 17B, and 17C, respectively, to a voltage proportional to the desired intensity of sub-pixels 58, 78, and 98, which proportional voltage was previously determined. Column conductor driver circuits 47A, 47B, and 47C shut off sub-pixels 58, 78, and 98 after the proper amount of charge or current has been emitted.

After the electron emitter structures $\mathbf{24}_{(29,\ 17A)}$ $\mathbf{24}_{(29,\ 17B)}$, and $\mathbf{24}_{(29,\ 17C)}$ have emitted the desired current, they are turned off by switching column conductor driver circuits 47A, 47B, and 47C from the high impedance state to a high voltage state. This is shown as occurring at time $t_9$ in FIG. 3. It should also be noted that at time $t_9$, the output voltage of row conductor driver circuit 39 switches from a high voltage, e.g. eighty volts, to a low voltage, e.g., zero volts and the outputs of column conductor circuits 47A, 47B, and 47C are maintained at a high voltage state since the pixels associated with column conductors 17A, 17B, and 17C must remain inactive during second sub-frame 202 of frame 200.; thereby discharging capacitances 55, 75, and 95 associated with column conductors 17A, 17B, and 17C, respectively.

The second sub-frame 202 of frame 200 begins at a time between times $t_9$ and $t_{10}$. During second half 202, column conductor driver circuits 47A, 47B, and 47C output, for example, eighty volts; thereby inactivating column conductors 17A, 17B, and 17C, respectively. Column conductor driver circuits 48A, 48B, and 48C, on the other hand, are activated. At time $t_{10}$, display capacitances 61, 63, 65, 81, 83, 85, 101, 103, and 105 are discharged to zero volts because the output voltages of column conductor driver circuits 48A, 48B, and 48C and row conductor driver circuits 37, 38, and 39 are such as to prevent electron emitter structures 24 from emitting current. By way of example, the output voltages of column conductor driver circuits 48A, 48B, and 48C and the output voltages of row conductor driver circuits 37, 38, and 39 are driven to zero volts.

At time $t_{10}$, column conductor driver circuits 48A, 48B, and 48C are placed in a high impedance state and are, therefore, electrically disconnected from FED 10. Row conductor driver circuits 37, 38, and 39 are then sequentially activated as indicated in timing diagram 200 shown in FIG. 3. At time $t_{10}$, row conductor driver circuits 37, 38, and 39 are outputting, for example, zero volts. This places zero volts on row conductors 27, 28, and 29, respectively.

At time $t_{11}$, row conductor driver circuit 37 is activated and places a voltage greater than the threshold voltage of the electron emitter structures on row conductor 27. By way of example, the voltage placed on row conductor 27 is eighty volts. Row conductor driver circuits 38 and 39 continue to maintain row conductors 28 and 29, respectively, at zero volts.

When the column conductor driver circuits are in a high impedance state and the electron emitter structures are emitting current, the column conductor driver circuits preferably monitor the voltage on the column conductor. The change in voltage measured on the column conductor is proportional to the charge or current emitted by the electron emitter structures. After the electron emitter structures $\mathbf{24}_{(27,\ 18A)}$, $\mathbf{24}_{(27,\ 18B)}$, and $\mathbf{24}_{(27,\ 18C)}$ have emitted the desired current, they are turned off by switching column conductor driver circuits 48A, 48B, and 48C from the high impedance state to a high voltage state. This is shown as occurring at time $t_{12}$ in FIG. 3.

At time $t_{13}$, the output voltages of row conductor driver circuit 37 and column conductor driver circuits 48A, 48B, and 48C are switched from a high voltage, e.g., eighty volts, to a low voltage, e.g., zero volts; thereby discharging capacitances 61, 81, and 101 associated with column conductors 18A, 18B, and 18C.

At time $t_{14}$, column conductor driver circuits 48A, 48B, and 48C are placed in a high impedance state and the output voltage of row conductor driver circuit 38 transitions from a low voltage state, e.g., zero volts, to a high voltage state, e.g., eighty volts. Column conductor driver circuits 48A, 48B, and 48C monitor the voltage on column conductors 18A, 18B, and 18C, respectively, and electron emitter structures $\mathbf{24}_{(28,\ 18A)}$ $\mathbf{24}_{(28,\ 18B)}$, and $\mathbf{24}_{(28,\ 18C)}$ emit current. Column conductor driver circuits 48A, 48B, and 48C compare the measured change in voltage on the respective column conductors 18A, 18B, and 18C to voltages proportional to the desired intensity of sub-pixels 67, 87, and 107, which proportional voltages were previously determined. Column conductor driver circuits 48A, 48B, and 48C shut off the respective sub-pixels 67, 87, and 107 after the desired amount of charge or current has been emitted. After electron emitter structures $\mathbf{24}_{(28,\ 18A)}$ $\mathbf{24}_{(28,\ 18B)}$, and $\mathbf{24}_{(28,\ 18C)}$ have emitted the desired current, they are turned off by switching column conductor driver circuits 48A, 48B, and 48C from the high impedance state to a high voltage state. This is shown as occurring at time $t_{15}$ in FIG. 3.

At time $t_{16}$, the output voltage of row conductor driver circuit 38 and column conductor driver circuits 48A, 48B, and 48C switch from a high voltage, e.g. eighty volts, to a low voltage, e.g., zero volts; thereby discharging capacitances 63, 83, and 103 associated with column conductors 18A, 18B, and 18C, respectively.

At time $t_{17}$, column conductor driver circuits 48A, 48B, and 48C are placed in a high impedance state and the output voltage of row conductor driver circuit 39 transitions from a low voltage state, e.g., zero volts, to a high voltage state, e.g., eighty volts. Column conductor driver circuits 48A, 48B, and 48C monitor the voltage on column conductors 18A, 18B, and 18C and electron emitter structures $\mathbf{24}_{(29,\ 18A)}$, $\mathbf{24}_{(29,\ 18B)}$, and $\mathbf{24}_{(29,\ 18C)}$ emit current. Column conductor driver circuits 48A, 48B, and 48C compare the measured change in voltage on column conductors 18A, 18B, and 18C, respectively, to a voltage proportional to the desired intensity of sub-pixels 68, 88, and 108, which proportional voltage was previously determined. Column conductor driver circuits 48A, 48B, and 48C shut off sub-pixels 68, 88, and 108 after the proper amount of charge or current has been emitted.

After the electron emitter structures $\mathbf{24}_{(29,\ 18A)}$, $\mathbf{24}_{(29,\ 18B)}$, and $\mathbf{24}_{(29,\ 18C)}$ have emitted the desired current, they are turned off by switching column conductor driver circuits 48A, 48B, and 48C from the high impedance state to a high voltage state. This is shown as occurring at time $t_{18}$ in FIG. 3. It should also be noted that at time $t_{18}$, the output voltage of row conductor driver circuit 39 switches from a high voltage, e.g. eighty volts, to a low voltage, e.g., zero volts; thereby discharging capacitances 65, 85, and 105 associated with column conductors 18A, 18B, and 18C, respectively.

Figure 4:
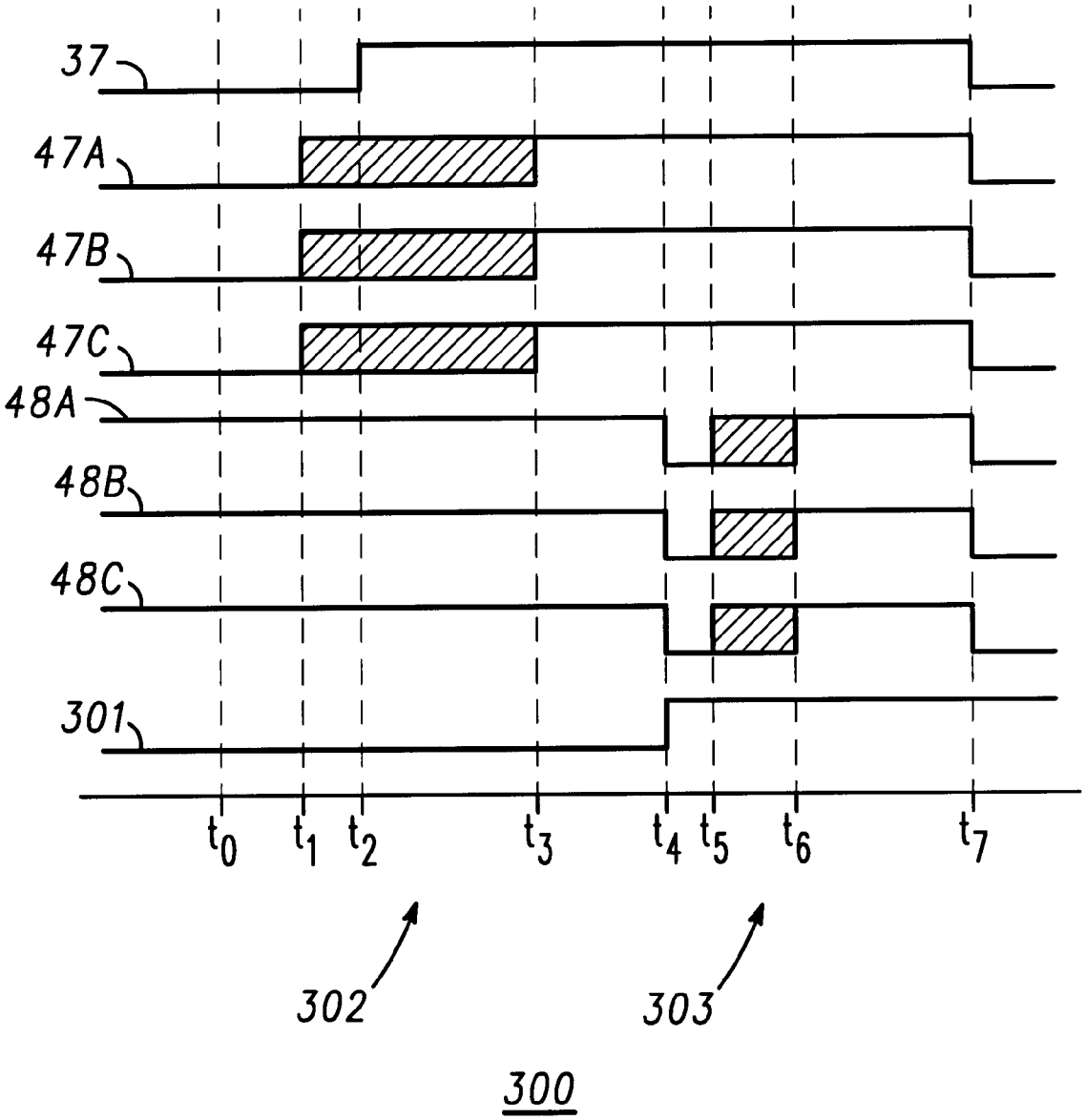
FIG. 4 is a timing diagram for the operation of the field emission display of FIG. 1 in accordance with another embodiment of the present invention.

FIG. 4 is a timing diagram 300 illustrating a method for operating FED 10 in a display mode in accordance with an alternative embodiment in which a single line time is divided into two sub-line times. In accordance with this embodiment, a single row is selected and every other column of the display is activated in a first half of the line time, then in a second half of the line time the alternate columns of the display are activated. For example, only row 27 is selected and columns 17A, 17B, and 17C of the display are activated during a first half of the line time and columns 18A, 18B, and 18C are selected during a second half of the line time. Then another row such as, for example, row 28 is selected.

In accordance with this present embodiment, during a portion 302 of line time 301, row driver circuit 37 selects row 27 and alternate column conductors are placed in an active mode, i.e., column conductors 17A, 17B, and 17C are placed in an active mode by column conductor driver circuits 47A, 47B, and 47C, respectively. At the same time column conductors 18A, 18B, and 18C are placed in an inactivate mode or turned off by column conductor driver circuits 48A, 48B, and 48C, respectively. During a portion 303 of line time 301, row 27 is still selected, however, column conductors 18A, 18B, and 18C are placed in an active mode by column conductor driver circuits 48A, 48B, and 48C, respectively, whereas column conductors 17A, 17B, and 17C are placed in an inactive mode by column conductor driver circuits 47A, 47B, and 47C, respectively. In other words, during portion 302 sub-pixels 50, 70, and 90 are capable of conducting current, whereas sub-pixels 60, 80, and 100 are turned off. During portion 303 of line time 301, sub-pixels 60, 80, and 100, are capable of conducting current whereas sub-pixels 50, 70, and 90 are turned off. It should be noted that the sub-pixels associated with the other rows of display 10, i.e., rows 28 and 29 are turned off, because these rows are not being selected during this time.

At time $t_0$, display capacitances 51, 53, 55, 71, 73, 75, 91, 93, and 95 are discharged to zero volts by driving the output voltage of column conductor driver circuits 47A, 47B, and 47C and row conductor driver circuits 37, 38, and 39 to voltages that prevent the corresponding electron emitter structures from emitting current. By way of example, the output voltages of column conductor driver circuits 47A, 47B, and 47C and the output voltages of row conductor driver circuits 37, 38, and 39 are driven to zero volts. Likewise, display capacitances 61, 63, 65, 81, 83, 85, 101, 103, and 105 are charged to a high voltage by driving the output voltage of column conductor driver circuits 48A, 48B, and 48C to a high voltage. At time $t_1$, column conductor driver circuits 47A, 47B, and 47C are placed in a high impedance state and are, therefore, electrically disconnected from FED 10. At time $t_1$, row conductor driver circuit 37 is outputting, for example, zero volts. This places zero volts on row conductor 27. The outputs of column conductor driver circuits 47A, 47B, and 47C remain in a high impedance state and the outputs of column conductor driver circuits 48A, 48B, and 48C remain in a high voltage state.

At time $t_2$, row conductor driver circuit 37 is activated and places a voltage greater than the threshold voltage of the electron emitter structures on row conductor 27. By way of example, the voltage placed on row conductor 27 is eighty volts. Row conductor driver circuits 38 and 39 continue to maintain row conductors 28 and 29, respectively, at zero volts.

When the column conductor driver circuits are in a high impedance state and the electron emitter structures are emitting current, the column conductor driver circuits preferably monitor the voltage on the respective column conductors. The change in voltage measured on the column conductor is proportional to the charge or current emitted by the electron emitter structures. It should be understood that column conductor driver circuits 47A, 47B, and 47C monitor the voltage on column conductors 17A, 17B, and 17C, respectively, and electron emitter structures $24_{(27, 17A)}$, $24_{(27, 17B)}$ and $24_{(27, 17C)}$ emit current. Column conductor driver circuits 47A, 47B, and 47C compare the measured change in voltage on the respective column conductors 17A, 17B, and 17C to voltages proportional to the desired intensity of sub-pixels 50, 70, and 90, which proportional voltages were previously determined as described in the U.S. Patent application having attorney docket number FD20024 by Robert T. Smith, and assigned to Motorola, Inc, which patent application has been incorporated herein by reference. After electron emitter structures $24_{(27, 17A)}$, $24_{(27, 17B)}$, and $24_{(27, 17C)}$ have emitted the desired current, they are turned off by switching column conductor driver circuits 47A, 47B, and 47C from the high impedance state to a high voltage state. Column conductor driver circuits 47A, 47B, and 47C remain in this state until the end of line time 301 so that they remain inactive This is shown as occurring at time $t_3$ in FIG. 4.

It should be understood that the time period between times to and $t_4$ represent the first half 302 of the line time 301. After time $t_4$, the second half 303 of the line time 301 begins. During the second half 303 of the line time, column conductors 18A, 18B, and 18C are exercised by means of column conductor driver circuits 48A, 48B, and 48C, respectively. During the second half 302 of the line time, column conductor driver circuits 47A, 47B, and 47C continue to place a high voltage on column conductors 17A, 17B, and 17C, respectively so that the pixels associated with column conductors 17A, 17B, and 17C remain inactive during the second half 303 of line time 301. At time $t_4$, column conductor driver circuits 48A, 48B, and 48C transition to a low voltage state thereby discharging capacitances 63, 65, 83, 85, 103, and 105 and charge capacitances 61, 81, and 101.

At time $t_5$, column conductor driver circuits 48A, 48B, and 48C are placed in a high impedance state and are, therefore, electrically disconnected from FED 10. It should be understood that the time interval from times $t_4$ and $t_5$ is just long enough to charge and discharge the capacitances.

When the column conductor driver circuits are in a high impedance state and the electron emitter structures are emitting current, the column conductor driver circuits preferably monitor the voltage on the column conductor. The change in voltage measured on the column conductor is proportional to the charge or current emitted by the electron emitter structures. It should be understood that column conductor driver circuits 48A, 48B, and 48C monitor the voltage on column conductors 18A, 18B, and 18C, respectively, and electron emitter structures $24_{(27, 18A)}$, $24_{(27, 18B)}$ and $24_{(27, 18C)}$ emit current. Column conductor driver circuits 48A, 48B, and 48C compare the measured change in voltage on the respective column conductors 18A, 18B, and 18C to voltages proportional to the desired intensity of sub-pixels 60, 80, and 100, which proportional voltages were previously determined. After electron emitter structures $24_{(27, 18A)}$, $24_{(27, 18B)}$, and $24_{(27\ 18C)}$ have emitted the desired current, they are turned off by switching column conductor driver circuits 48A, 48B, and 48C from the high impedance state to a high voltage state. This is shown as occurring at time $t_6$ in FIG. 4.

At time $t_7$, the output voltage of row conductor driver circuit 37 and column conductor driver circuits 48A, 48B, and 48C are switched from a high voltage, e.g., eighty volts, to a low voltage, e.g., zero volts; thereby discharging capacitances 61, 81, and 101 associated with column conductors 18A, 18B, and 18C, respectively.

This process is then repeated to activate the next row conductor, e.g., row conductor 28. The process is repeated until all the row conductors have been activated, one row at a time.

By now it should be appreciated that a method for preventing voltage glitches caused by cross-talk in a field emitter display has been provided. The present invention prevents voltage glitches arising from a switching column conductor from being capacitively coupled to an adjacent non-switching column conductor, thereby preventing degradation of the image output by the FED. In particular, the method of the present invention includes preventing a column conductor from switching from one operating state to another operating state when a column conductor driver circuit is placing a high impedance on the adjacent column conductor.

While specific embodiments of the present invention have been shown and described, further modifications and improvements will occur to those skilled in the art. It is understood that the invention is not limited to the particular forms shown and it is intended for the appended claims to cover all modifications which do not depart from the spirit and scope of this invention. For example, the row and column conductor driver circuits can be implemented using a microprocessor.

What is claimed is:

1. A method for reducing cross-talk between column conductors of a field emission display, the field emission display having a plurality of column conductors on which electron emitter structures are disposed and a plurality of row conductors, wherein the plurality of column conductors and the plurality of row conductors cooperate to form sub-pixels, comprising:

causing a portion of the electron emitter structures disposed on the first and second column conductors to emit electrons, thereby defining first and second emission currents, respectively, wherein the first and second column conductors are adjacent each other; and preventing the first emission current from substantially changing value when the second emission current is discharged or otherwise varied, preventing adjacent column conductors of the plurality of column conductors from switching when one of the adjacent column conductors is in a high impedance state.

2. The method of claim 1, wherein causing a portion of the electron emitter structures to emit electrons comprises applying a row select voltage to a row conductor of the plurality of row conductors.

3. The method of claim 1, wherein causing a portion of the electron emitter structures to emit electrons comprises applying a column select voltage to a column conductor of the plurality of column conductors.

4. The method of claim 1 further including coupling a column conductor driver circuit to a column conductor of the plurality of column conductors, the column conductor driver circuit including a tri-state driver.

5. A method for reducing cross-talk in a field emission display, the field emission display having a first column conductor adjacent to and spaced apart from a second column conductor and a third column conductor adjacent to and spaced apart from the second column conductor, and at least one row conductor, wherein each column conductor has electron emitter structures disposed thereon, the method comprising preventing the first column conductor from switching from a first operating state to a second operating state when the second column conductor is in a high impedance state.

6. The method of claim 5, further including cycling the first column conductor through a discharge, charge, and turn-off sequence and placing the second column conductor in an off state during a first portion of a line time.

7. The method of claim 6, wherein cycling the first column conductor through the discharge, charge, and turn-off sequence includes discharging capacitances associated with the first column conductor and the third column conductor.

8. The method of claim 6, wherein cycling the first column conductor through the discharge, charge, and turn-off sequence includes placing the first column conductor in a high impedance state and placing a voltage on the at least one row conductor that is greater than a threshold voltage of the electron emitter structures disposed on the first column conductor.

9. The method of claim 6, wherein cycling the first column conductor through the discharge, charge, and turn-off sequence includes switching the first column conductor from the high impedance state to a state having a voltage greater than a threshold voltage of the electron emitter structures disposed on the first column conductor.

10. The method of claim 9, wherein cycling the first column conductor through the discharge, charge, and turn-off sequence further includes placing a voltage on the at least one row conductor that is less than the threshold voltage of the electron emitter structures disposed on the first column conductor.

11. The method of claim 6, further including cycling the third column conductor through a discharge, charge, and turn-off during the first portion of the line time.

12. The method of claim 11, further including placing the third column conductor in the high impedance state during the first portion of the line time.

13. The method of claim 11, wherein cycling the third column conductor through the discharge, charge, and turn-off sequence includes switching, during the first portion of the line time, the third column conductor from the high impedance state to a state having a voltage greater than a threshold voltage of the electron emitter structures disposed on the third column conductor.

14. The method of claim 13, wherein cycling the third column conductor through the discharge, charge, and turn-off sequence further includes, during the first portion of the line time, placing a voltage on the at least one row conductor that is less than the threshold voltage of the electron emitter structures disposed on the third column conductor.

15. The method of claim 6, further including cycling the second column conductor through the discharge, charge, and turn-off sequence and placing the first column conductor and the third column conductor in the off state during a second portion of the line time.

16. A method for attenuating cross-talk in a field emission display having a first plurality of column conductors activated during a first time period of a line time interdigitated with a second plurality of column conductors activated during a second period of the line time, wherein the field emission display includes at least one electron emitter structure disposed on each column conductor and at least one row conductor coupled to each of the plurality of column conductors, the method comprising:

during the first period of the line time, maintaining the second plurality of conductors in an off state; and during the first period of the line time, activating a portion of the first plurality of conductors.

17. The method of claim 16, wherein activating the first portion of the first plurality of column conductors comprises discharging the capacitances associated with a first column conductor of the first plurality of column conductors, causing the electron emitter structures disposed on the first column conductor to emit a current, and turning off the electron emitter structures disposed on the first column conductor after a desired amount of current has been emitted, wherein the first column conductor of the first plurality of column conductors is adjacent a first column conductor of the second plurality of column conductors.

18. The method of claim 17, wherein discharging the capacitances associated with the first column conductor includes placing the first column conductor and the at least one row conductor at a voltage that is less than a threshold voltage of the electron emitter structures disposed on the first column conductor.

19. The method of claim 18, wherein the voltage is substantially zero volts.

20. The method of claim 17, wherein causing the electron emitter structures disposed on the first column conductor to emit current comprises placing the first column conductor in a high impedance state and coupling a voltage to the at least one row conductor that is higher than a threshold voltage of the electron emitter structures disposed on the first column conductor.

21. The method of claim 17, wherein turning off the electron emitter structures disposed on the first column conductor comprises placing a voltage on the first column conductor that is greater than the threshold voltage of the electron emitter structures disposed on the first column conductor.

22. The method of claim 16, wherein activating the first portion of the first plurality of column conductors comprises discharging the capacitances associated with a third column conductor of the first plurality of column conductors, causing the electron emitter structures disposed on the second column conductor to emit a current, and turning off the electron emitter structures disposed on the second column conductor after a desired amount of current has been emitted, wherein a first column conductor of the second plurality of column conductors is between the first and third column conductors of the first plurality of column conductors.

23. The method of claim 22, wherein discharging the capacitances associated with the second column conductor includes placing the third column conductor and the at least one row conductor at a voltage that is less than a threshold voltage of the electron emitter structures disposed on the third column conductor.

24. The method of claim 23, wherein the voltage is substantially zero volts.

25. The method of claim 22, wherein causing the electron emitter structures disposed on the third column conductor to emit current comprises placing the third column conductor in a high impedance state and coupling a voltage to the at least one row conductor that is higher than a threshold voltage of the electron emitter structures disposed on the third column conductor.

26. The method of claim 22, wherein turning off the electron emitter structures disposed on the third column conductor comprises placing a voltage on the third column conductor that is greater than the threshold voltage of the electron emitter structures disposed on the third column conductor.

* * * * *